US006896355B2

(12) United States Patent
Clarke et al.

(10) Patent No.: US 6,896,355 B2
(45) Date of Patent: May 24, 2005

(54) PRINTHEAD POSITIONING MECHANISM

(75) Inventors: Leo C. Clarke, Albany, OR (US); Douglas C. Snell, Albany, OR (US)

(73) Assignee: Hewlett-Packard Development Company, LP., Houston, TX (US)

( * ) Notice: Subject to any disclaimer, the term of this patent is extended or adjusted under 35 U.S.C. 154(b) by 0 days.

(21) Appl. No.: 10/452,522

(22) Filed: Jun. 2, 2003

(65) Prior Publication Data

US 2004/0239720 A1 Dec. 2, 2004

(51) Int. Cl.[7] ..... B41J 23/00
(52) U.S. Cl. ..... 347/37
(58) Field of Search ..... 347/20, 37, 7, 347/6, 5, 1, 68, 95, 48, 98; 73/861; 346/139 R

(56) References Cited

U.S. PATENT DOCUMENTS

| | | | |
|---|---|---|---|
| 3,854,563 | A | 12/1974 | Cowardin et al. |
| 5,291,355 | A | 3/1994 | Hatch et al. |
| 5,296,981 | A | 3/1994 | Ogawa |
| 5,305,169 | A | 4/1994 | Anderson et al. |
| 5,841,610 | A | 11/1998 | Battu et al. |
| 6,310,691 | B2 | 10/2001 | Cariffe |
| 6,336,756 | B1 | 1/2002 | Toyama et al. |
| 6,386,667 | B1 | 5/2002 | Cariffe |

OTHER PUBLICATIONS

Chapter 11 of a Tutorial entitled "Actuators", pp. 1 through 41, taken from the website at http://www.consult–g2.com/course/chapter11/chapter.html, dated Apr. 22, 2003.

The Third–GenerationHP Thermal InkJet Printhead by J. Stephen Aden, et al., Feb. 1994, Hewlett–Packard Journal, pp. 41–45.

Thermal Inkjet Review, or How Do Dots Get from the Pen to the Page? by James P. Shields, Aug. 1992, Hewlett–Packard Journal, pp. 67–68.

Development of a High–Resolution Thermal Inkjet Printhead by William A. Buskirk et al, Oct. 1988 Hewlett–Packard Journal, pp. 55–86.

Hewlett–Packard Journal, May 1985, vol. 36, No. 5, pp. 1–27.

International Search Report and Written Opinion re Application No. PCT/US2004/01599 mailed Oct. 11, 2004.

*Primary Examiner*—Raquel Yvette Gordon

(57) ABSTRACT

A printhead positioning mechanism has an arm mounted on a pivot member and having a first portion adapted to move along an arcuate path. A printhead is mounted on an arm.

47 Claims, 5 Drawing Sheets

PRINTHEAD POSITIONING MECHANISM

BACKGROUND OF THE DISCLOSURE

Commercial products such as computer printers, graphics plotters, and facsimile machines have been implemented with ink jet technology for producing printed media. The contributions of Hewlett-Packard Company to ink jet technology are described, for example, in various articles in the Hewlett-Packard Journal, Vol. 36, No. 5 (May 1985); Vol. 39, No. 54 (October 1988); Vol. 43, No. 4 (August 1992); Vol. 43, No. 6 (December 1992); and Vol. 45, No. 1 (February 1994). Example physical arrangements of the orifice plate, ink barrier layer and thin film substructure of printheads are described at page 44 of the Hewlett-Packard Journal of February 1994, cited above, and are also described in U.S. Pat. Nos. 4,719,477 and 5,317,346.

Generally, an ink jet image is formed pursuant to precise placement on a print medium of ink drops emitted by an ink drop generating device known as an ink jet printhead. Typically, an ink jet printhead is supported on a movable print carriage that traverses in linear fashion over the surface of the print medium and is controlled to eject drops of ink at appropriate times pursuant to command of a microcomputer or other controller, wherein the timing of the application of the ink drops is intended to correspond to a pattern of pixels of the image being printed.

Typical desktop printers and larger plotters use a rectilinear left and right positioning system to linearly move an ink jet print cartridge or printhead left and right across the surface of a sheet of paper or other printing medium. These printing mechanisms are well suited to scaling upward in size, as demonstrated by desktop printer designs being modified into D & E size plotters.

Although traditional printer system designs have been modified to achieve a certain degree of miniaturization, the nature of and the complexity of rectilinear printing mechanisms pose some drawbacks to miniaturization. Rectilinear motion printing mechanisms typically have motors, gears, cogs, belts, belt-driven or gear assemblies, linear encoders and/or other parts which create motion to drive a printhead left and right across the paper swath. The cost-effectiveness of such assemblies and components decreases with further miniaturization.

Power consumption is a consideration in designing small devices for portable use. Rectilinear print mechanisms, however, limit the portable power efficiency of printing devices. As rectilinear printer designs shrink in size, the printers become less energy efficient due, in part, to the deceleration and acceleration of system components required to reverse direction as the printhead reaches the end of its travel; the shorter the travel, the greater the proportion of the total energy for moving the printhead that is used for reversing directions. The amount of energy consumed is proportional to the mass of the printhead with the associated carriage structure. The gears and belts used in rectilinear printer mechanisms have friction losses. Power consumption due to friction losses on acceleration/deceleration is a major constraint for battery life and initial cost to the customer.

SUMMARY OF THE DISCLOSURE

A printhead positioning mechanism has an actuator arm pivotably mounted on a pivot member. A printhead is mounted on the actuator arm.

DETAILED DESCRIPTION

Figure 1:
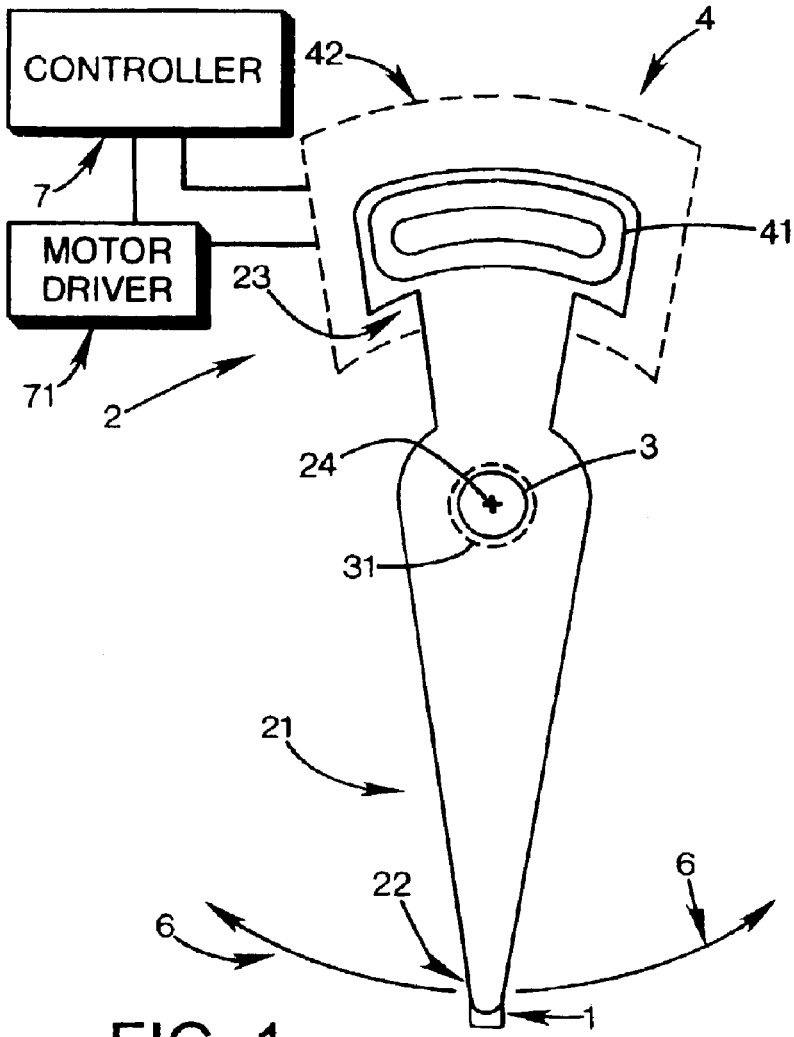
FIG. 1 is a top view of an embodiment of a printhead positioning assembly which moves the printhead in an arcuate path.

Exemplary embodiments of printhead positioning mechanisms and printing systems are illustrated in FIGS. 1–6. In an exemplary embodiment shown in FIG. 1, an ink jet printhead 1 is mounted on an actuator arm 2. The shape of the actuator arm 2 may vary. The actuator arm is rotatably mounted on a pivot member 3. The pivot member may be mounted or supported on a frame or housing 32 (FIG. 1A). A drive motor 4 rotates the actuator arm 2 about the pivot member 3, thereby moving the position of the printhead 1 over the surface of a print medium 5 (FIG. 5) in an arcuate path 6. In an exemplary embodiment, the printhead is an ink jet printhead, e.g. comprising a nozzle array for ejecting ink in small droplets.

Figure 1A:
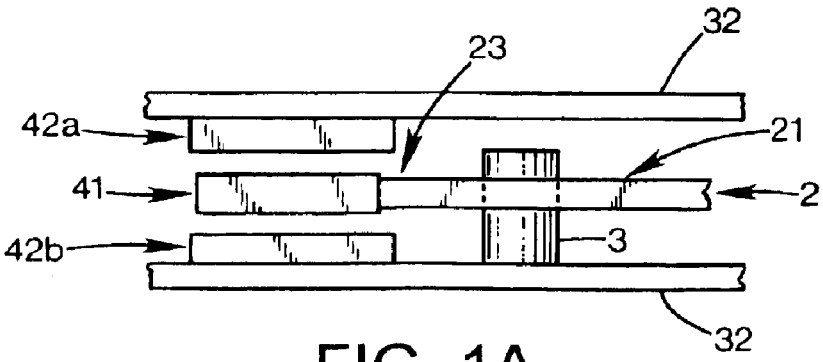
FIG. 1A is a side view of a portion of an embodiment of a printhead positioning assembly.

In the exemplary embodiment shown in FIG. 1, the actuator arm has a first portion 21 and a second portion 23 disposed on opposite sides of the pivot member 3. A printhead 1 is mounted on the first portion 21 of the actuator arm 2 and may be mounted at a distal end 22 of the first portion 21 of the actuator arm 2. The actuator arm 2 is rotatably mounted on a pivot member 3. The pivot member may include a pivot bearing 31. The pivot member is centered at a pivot point 24 of the actuator arm. A drive motor 4 rotates the actuator arm about the pivot member 3 and the pivot point 24. The pivot point may be selected for a particular embodiment based on factors, including, arm reach and arm distances/speeds desired or needed for a given application.

The drive motor 4 may be a voice coil motor. In one embodiment, the voice coil motor includes a movable voice coil 41 mounted on the second portion 23 of the actuator arm 2. The voice coil motor 4 may also have two permanent magnets 42*a* and 42*b* (FIG. 1A) which may be mounted in spaced relation with one above and one below the arcuate path of the voice coil 41 on the actuator arm 2. The voice coil and actuator arm move between the magnets. The two magnets 42*a*, 42*b* may be mounted on the frame or housing 32 for the printer. Drive signals are applied to the motor 4 from a motor driver 71, controlled by a controller 7. In some exemplary embodiments, the controller 7 and motor driver 71 can be fabricated in a single circuit. In response to the drive signals, typically applied to the coil 41 by a wiring connection between the motor driver and the coil 41, an electromotive force is applied to the voice coil 41, causing movement of the actuator arm 2 in an arcuate or rotational path about the pivot 24, in a movement path determined by the motor drive signals. The movement of the arm 2 is illustrated in FIG. 2.

In another embodiment (not shown), a magnet (not shown) is mounted on the second portion 23 of the actuator arm 2. In this embodiment, voice coils 41 could be mounted one above and one below the magnet, the magnet being able to move freely between the voice coils. The stationary voice coils may be mounted on a frame or housing 32 for the printer.

Voice coil motors have been developed for use, for example, to position read/write transducers in magnetic hard disk drives. Voice coil motors similar to those developed for use in magnetic hard disk drives may be suitable for use as the motor 4 of the printhead positioning mechanism of FIG. 1. Voice coil motors used in disk drive applications are described, for example, in U.S. Pat. No. 5,305,169, U.S. Pat. No. 5,296,981, and U.S. Pat. No. 5,291,355. Other drive motors may also be suitable for use as the motor 4 of a printhead positioning mechanism including, for example, stepper motors. Thermal drift compensation may be employed in some embodiments to compensate for position drift due to temperature change.

Figure 2:
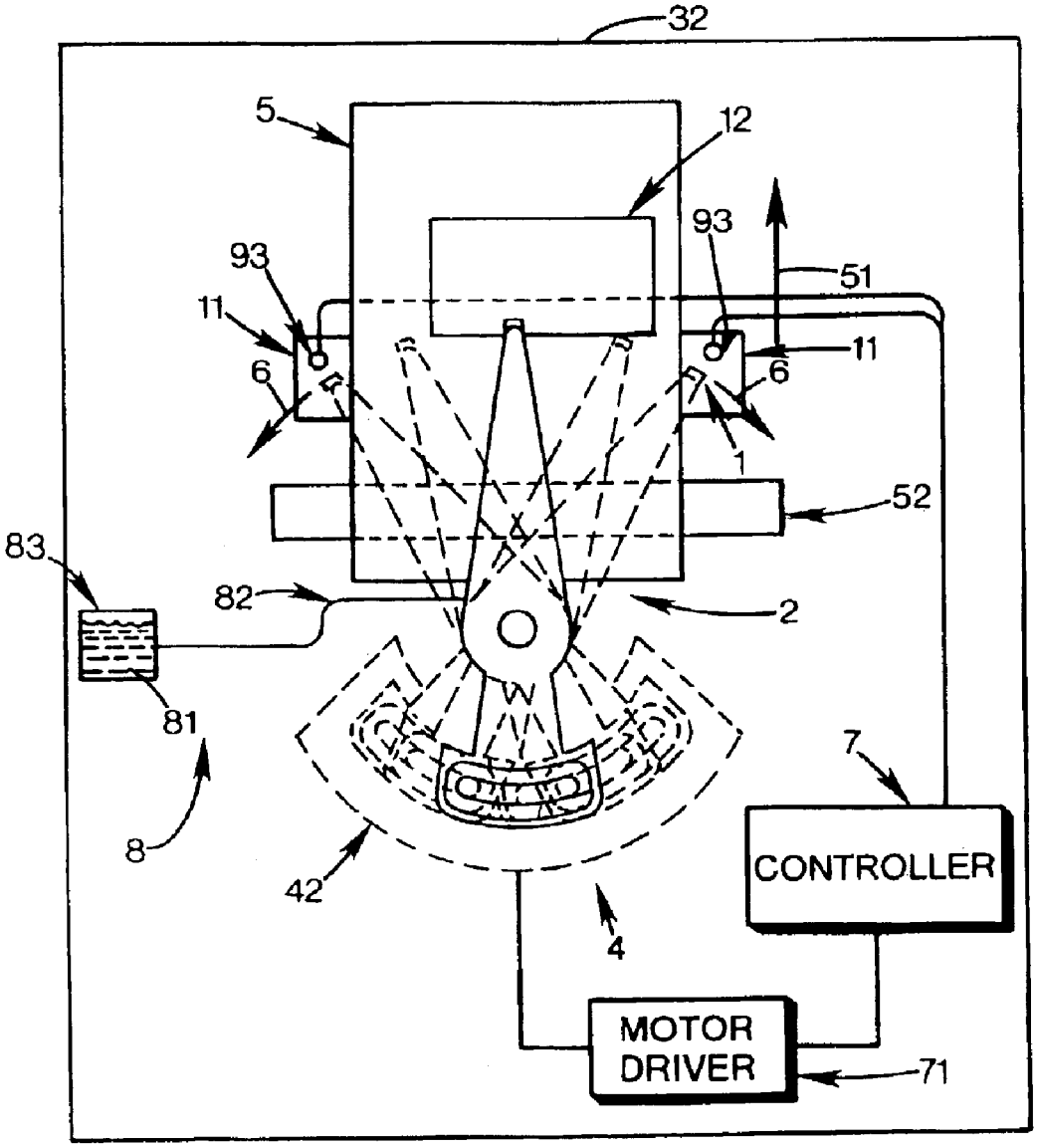
FIG. 2 is a top view of an embodiment of a printer with a printhead positioning assembly which moves the printhead in an arcuate path.

FIG. 2 diagrammatically illustrates a printer with a voice coil motor 4 for driving an actuator arm 2 to position a printhead 1, the printhead being moved in an arcuate path. The microcomputer or other controller 7 generates commands to control the motor 4 and the printhead 1 to eject drops of ink onto a surface of a print medium 5 at appropriate times. The ejection of the drops are timed so that the pattern of ink drops applied to the surface of the print medium 5 corresponds to a pattern of pixels of the image 12 being printed. The printer may include a frame or housing 32.

In an exemplary embodiment, an ink delivery system 8 may deliver ink 81 to the ink jet printhead. The ink delivery system 8 may be mounted, in part, on the actuator arm 2. The ink delivery system may include one or more ink hoses or ink tubes 82, which are fluidically connected with the printhead and fluidically connected with an ink supply 83 mounted off the arm 2 and supported by the frame or housing 32 and which provide a fluid path for ink to flow from the ink supply 83 to the printhead 1. In an alternate embodiment, the ink supply is mounted on the actuator arm 2 and may be formed integrally with the printhead.

The motor 4 allows electromechanical motion control of the actuator arm 2. In an exemplary embodiment, the position of the arm and the printhead is sensed by a position detection system 9 (FIG. 3). The position detection system 9 may include a "closed loop" position detection system with a radial segment encoder 91, which may be an optical encoder, and an encoder pickup 92. The radial segment encoder may be mounted on the actuator arm adjacent the voice coil. A radial segment encoder may be mounted at the end of the actuator arm or close to the pivot. The position detection system provides position information to the controller 7 for controlling the position of the actuator arm and the firing of the inkjet nozzles to create an image on the print medium in accordance with image data.

Figure 3A:
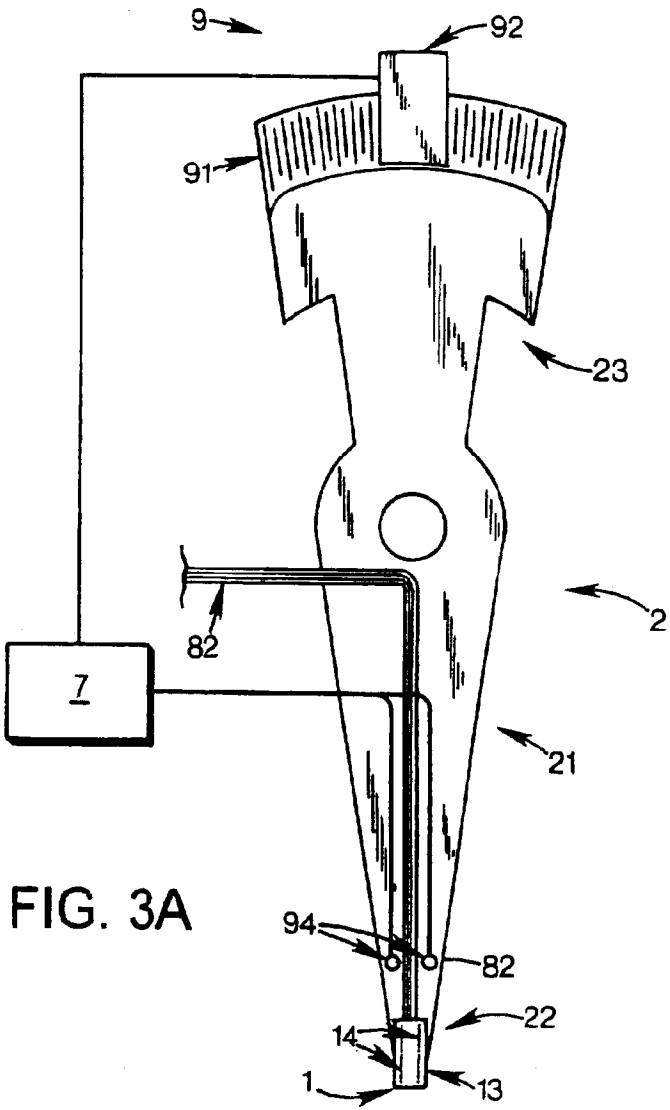
FIG. 3A is a bottom view of an embodiment of an actuator arm with a printhead and ink delivery tubes.
Figure 3:
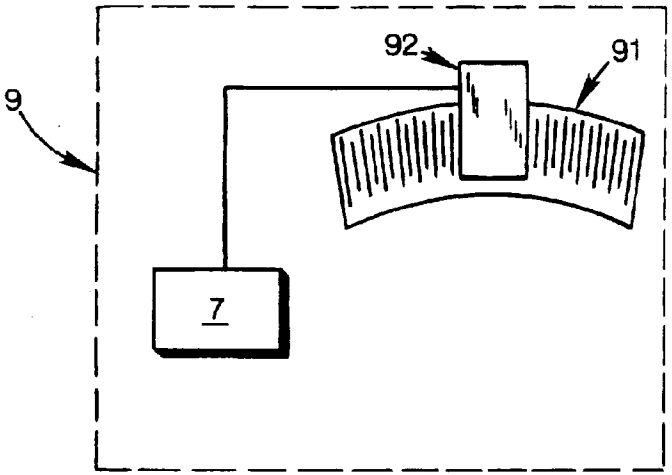
FIG. 3 illustrates an embodiment of a position detection system for a printhead positioning unit.

FIG. 3A diagrammatically shows an exemplary embodiment with a radial segment encoder 91 mounted on the actuator arm adjacent the voice coil and an encoder pickup 92. The encoder pickup may be mounted on the frame or housing 32 (FIG. 2). In an alternative embodiment, a radial segment encoder could be mounted on the frame or housing, with the encoder pickup mounted on the actuator arm. The position detection system 9 may also include or alternatively include an "open loop" position detector with an end of travel detector 93 (FIG. 2) at one or both opposite ends of travel. In the case of an "open loop" position detector, an end of travel detector 93 determines the position of the printhead or the actuator arm when it reaches the position at the end of its travel. The controller determines the position of the printhead or actuator arm when it is not at the end of travel by calculating the angular distance traveled from the end of travel. An end of travel detector may, for example, include a photo interrupter (for example, with an emitter/detector pair), Hall effect proximity sensors or magnetic effect sensors.

A printer with an arcuate printhead positioning system may include one or more service stations 11 (FIG. 2), which may have a wiper and a "spittoon," where the printhead may be primed and/or cleaned. A service station 11 may be the location used as a home parking station for a printhead when the actuator arm is idle or not in use. The service station may provide wiping, spitting and capping functions.

The high accuracy positioning available with a voice coil motor enables a radial printer to perform accurate image printing right up to the edges of a print medium (full bleed). Multiple swath printing is easily enabled. Because of the high slew rates of the swing arm system the printer can be designed for multiple pass printing without significantly delayed print output.

The accuracy of full-bleed printing may be further enhanced through use of a print medium edge detector or print medium edge sensor 94 (FIG. 3A). One factor which may limit the accuracy of full-bleed printing is an uncertainty in the location of the edge of a print medium. The controller may control the printhead based on the position of the printhead relative to the print medium as determined, at least in part, by the position sensing system 9 and the expected location of the print medium with respect to the printhead. However, the actual location of the edge of the print medium may deviate from the expected location of the edge of the print medium due, in part, to uncertainties caused by manufacturing and operational tolerances of the printer and printhead positioning system and or print medium transport mechanism and/or the flexibility or non-rigidity of various print media. A print medium detector may include, for example, at least one of a photoelectric sensor (through-beam or reflective), a laser sensor, surface-mount technology (SMT) IR device, and/or an emitter/detector pair—one mounted on the actuator arm and the opposite pair partner on the opposed side of the edge of the print medium. Other suitable print medium detectors may alternatively be employed.

A print medium edge detector 94 may be located on the actuator arm to detect the actual relative location of the printhead with respect to the edge of the print medium (FIG. 3). This information is relayed to the controller 7. The controller 7 may use this information, in part, to control the individual nozzles 14 to create the image on a print medium. Detecting the actual position of the edge of the print medium with respect to the printhead may improve the accuracy of full-bleed printing.

In an exemplary embodiment diagrammatically shown in FIG. 3A, the printhead includes an ink jet die 13 with a plurality of ink jet nozzles 14. The nozzles 14 may be in an orifice plate that is attached to or integral with an ink barrier layer that in turn is attached to a thin film substructure that implements ink firing heater resistors and apparatus for enabling the resistors. The ink barrier layer defines ink channels including ink chambers disposed over associated ink firing resistors, and the nozzles in the orifice plate are aligned with associated ink chambers. Ink drop generator regions are formed by the ink chambers and portions of the thin film substructure and the orifice plate that are adjacent the ink chambers. The controller 7 generates control signals in response to image data and position data, which may be provided by a position detection system 9.

The printhead can eject ink droplets from positions along the arcuate path 6. However, a print medium 5 may be larger (i.e., wider) than the area covered by the printhead arcuate path. FIG. 2 shows a printer with a print medium transport mechanism 52 to move the print medium 5 in a print medium advance direction 51 adjacent the area of the arcuate path 6 described by the printhead so that the image 12 can be formed on successive portions of the print medium which are advanced along the advance direction 51.

Figure 4:
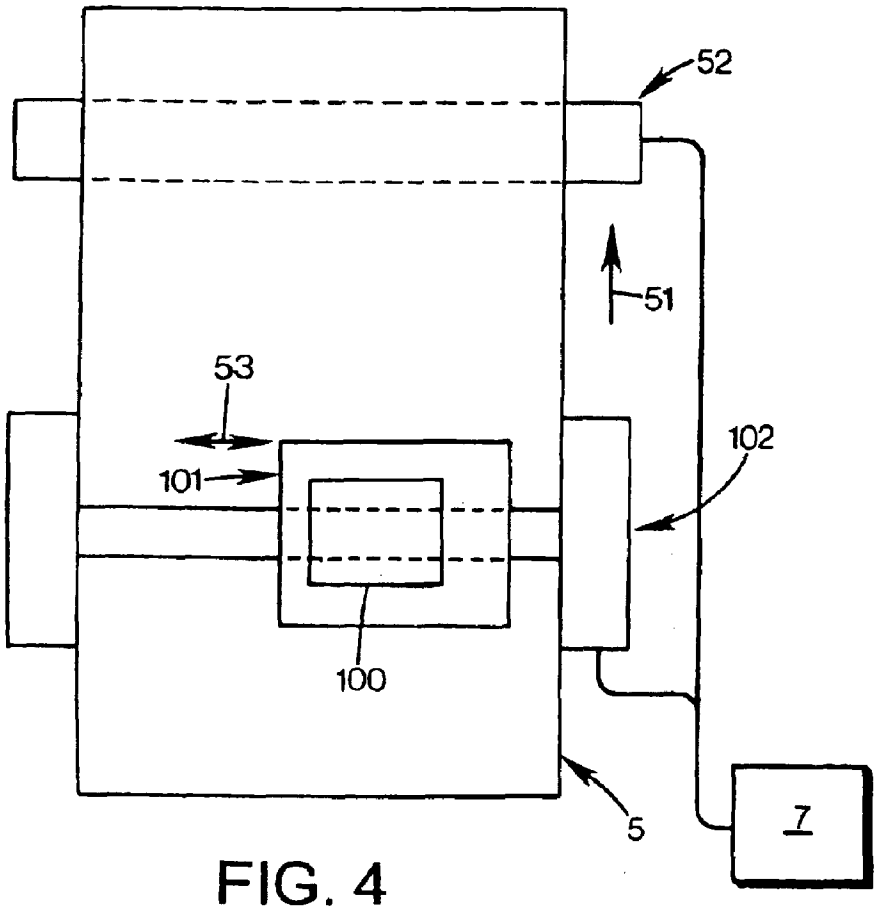
FIG. 4 shows an embodiment of a printhead positioning unit mounted on a carriage.

In other embodiments, the printhead 1, the drive motor 4 and the actuator arm 2 could be mounted as a printhead positioning unit 100 on a carriage 101. A carriage drive may move the carriage, with the printhead, the drive motor and the actuator arm, over the surface of a print medium. FIG. 4 diagrammatically illustrates a printhead positioning unit 100 mounted on a carriage 101. The carriage drive 102 moves the carriage 101 and the unit 100 across the surface of the print medium 5 along a swath axis 53. A print medium transport means 5 may be used in conjunction with the carriage 101 and carriage drive 102 to move the print medium in a print medium direction 51. In a larger, conventional-style printer, a printhead positioning unit 100 could be mounted on a carriage in the location where a cartridge would conventionally be located. As the printhead positioning unit is moved across the print medium, the actuator arm moves the printhead back and forth resulting in a large print swath.

Figure 6:
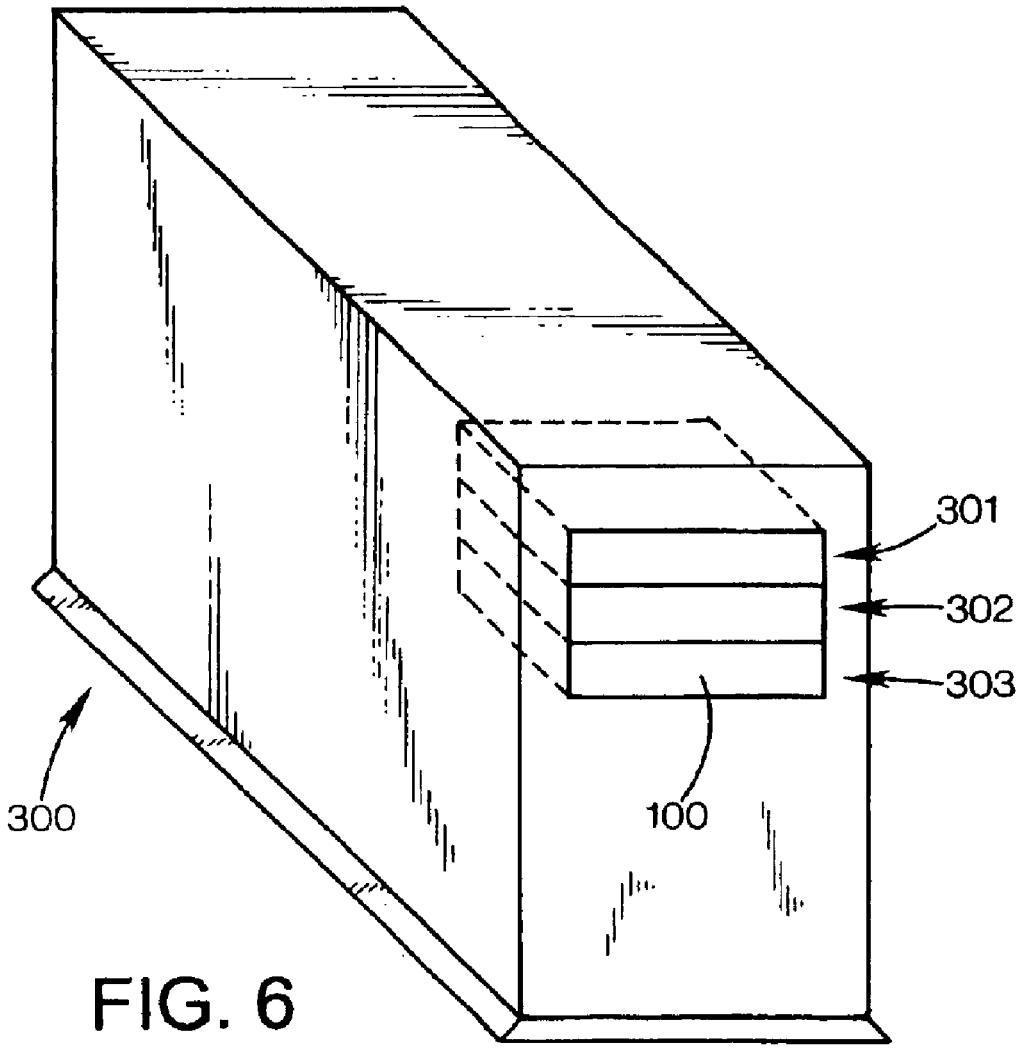
FIG. 6 shows an embodiment of a computer with a printer installed in a hardware bay.

A printer with a voice coil motor to drive an actuator arm can be manufactured with sizes similar to the size of hard disk drives, including micro-hard disk drives. Printers which are designed and manufactured with a size on the order of the size of a hard disk drive are suitable for use with and may be incorporated into small devices such as "palm tops" or digital cameras. They may also be suitable for integration into the hard drive or hardware bays of a portable computer, or otherwise into the housing of a personal computer. FIG. 6 diagrammatically illustrates a computer 300 with three hardware bays 301, 302 and 303. A computer may have, for example, an optical disk drive installed in hardware bay 301, a magnetic disk drive in hardware bay 302 and a printer comprising one or more units 100 in hardware bay 303.

Voice coil motors can drive actuator arm-mounted printheads at speeds such that the printer may achieve higher print rates with smaller ink jet dies than the print rates attainable by printheads of conventional rectilinear printers. Using a smaller ink jet die would also increase manufacturing efficiencies because more printheads could be manufactured from a given wafer, for example a six inch wafer. A six inch wafer could, for example, produce as many as 50% or more additional ink jet dies suitable for use with voice coil printers than could be produced for traditional rectilinear printer designs.

An exemplary embodiment of a printer with a printhead mounted on an actuator arm and driven by a voice coil motor may operate with higher efficiency than conventional rectilinear print mechanisms. High speed printing may involve moving more nozzles faster using a larger, more expensive die. A voice coil printer allows a smaller, less expensive, direct drive die to move very fast across the surface of a print medium. A typical 2 inch disk drive mechanism, for example, can move a read/write head from the inside track to the outside track of a hard disk in about 10 milliseconds with positional accuracy greater than is typically demanded in ink jet printing.

An embodiment of a printer with a printhead positioning system as described above can be very small, very fast and be operated at low cost. The printer can translate an actuator arm with a very small printhead attached to it at very high access speeds due to the low mass of the arm and printhead. The printhead and actuator arm have low swept mass which leads to reduced acceleration/deceleration distances for edge bleed printing. The printhead may have a smaller number of nozzles which may be, for example, 10 nozzles mounted on an end of the actuator arm.

Exemplary embodiments of voice coil printers are mechanically less complex than a conventional rectilinear printer. The gearing and/or belting for moving a printhead back and forth is replaced by an arm that rotates around a pivot member, which may include a pivot bearing.

An exemplary embodiment of a voice coil printer may have very low power consumption in comparison with rectilinear printers. Although the head is still required to move back and forth and accelerate and decelerate at the end of each sweep, the inefficiency of reversing directions is reduced by the small mass of the arm and printhead. Also, using a pivot point and voice coil actuator increases the efficiency of the drive.

The printing speed depends on several factors, including: the swath distance (distance of a single pass of the printhead over the print medium), the maximum firing frequency of the printhead, the dpi of the print, the dpi of the printhead (the spacing between nozzles) and the time needed to reverse the direction of the printhead movement at the end of each swath.

An exemplary embodiment may have a two inch swath, horizontal print density of 300 dpi, and a maximum firing frequency of 12 kHz with a swath time of 50 msec. An exemplary printhead may also have a dpi of 300 with 10 nozzles on the head and a vertical print density of 300 dpi. The time needed to reverse the printhead may be, for example, 10 msec, in which case the mechanism could print at the rate of 0.66 inch/sec. A print area two inches wide by three inches long could be printed in approximately 6 seconds.

An exemplary embodiment consumes power during each swath due to the acceleration and deceleration of the mechanism. The power consumption is affected by the speed of the printhead and the mass of the printhead. The small mass of a small printhead suitable for use in the printer reduces the rate of power consumption per swath over conventional rectilinear printers. The savings may be somewhat offset by the fact that smaller printheads with fewer nozzles need more swaths to achieve the same amount of printing. However, certain embodiments may have acceptable printing speed while minimizing power consumption to consume less power than a conventional rectilinear printer. Voice coil printhead drive mechanisms may incur lower friction losses than a conventional, rectilinear belt drive system.

A given nozzle of a printhead that describes an arcuate path ejects ink droplets onto the surface of a print medium in an arc. If the printhead creates an ink drop trajectory error or tail, any errors in the image are masked, relative to how those errors would appear in a rectilinear printer, because the orientation of any tail or trajectory error is changed relative to the paper advance axis. If ink drops are not ejected from a nozzle or are misdirected, any defects caused by the missing pixels may therefore be harder for a human eye to detect because the defect will not be a horizontal, more readily detectible line.

Figure 5:
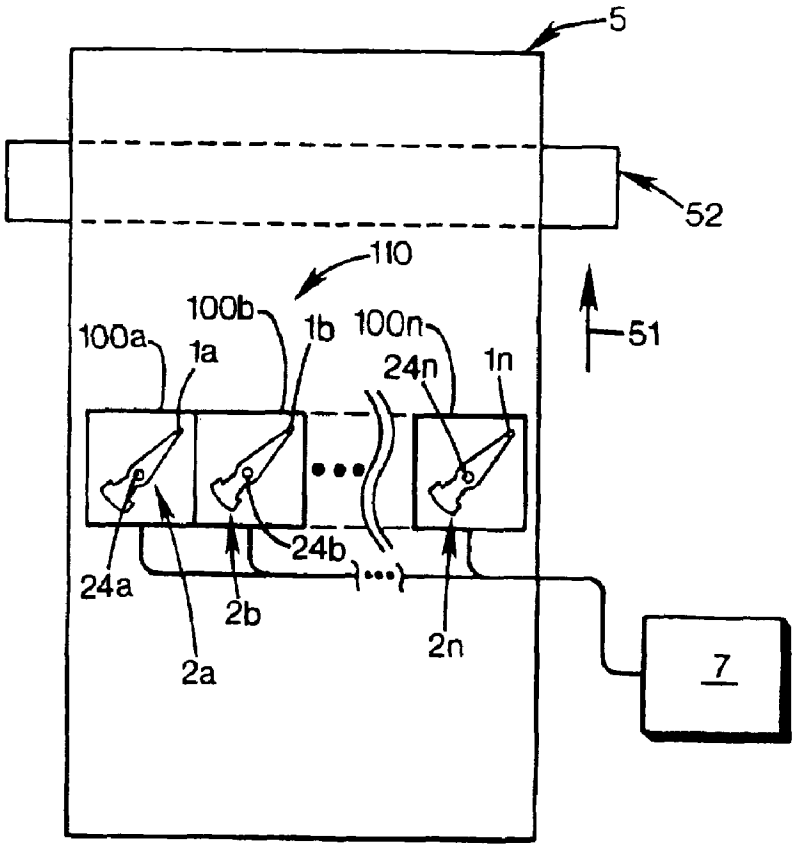
FIG. 5 shows an embodiment of an array of printhead positioning units.

In certain embodiments, an array 110 of printhead positioning units 100*a*–100*n* could be used to print images in sizes larger than the size achievable by one printer unit alone. FIG. 5 shows an array 110 of printhead positioning units 100*a*–100*n*. The array may include a plurality of individual printhead positioning units 100*a*, 100*b* . . . 100*n* sufficient to form an image consistent with images produced by a standard-sized printer, a large format printer or plotter or any desired size. The respective units include arms 2*a* . . . 2*n* mounted for pivoting movement about pivots 24*a* . . . 24*n*, each having a printhead 1*a* . . . 1*n* mounted thereon for movement about an arcuate path. A printer could include at least a first arm 2*a* and a second arm 2*b*, the first arm having a first printhead mounted thereon and the second arm having a second printhead mounted thereon. The arms 2*a*, 2*b* are configured to rotate about a first axis 24*a* or a second axis 24*b* respectively.

Each printer mechanism 100*a*–100*n* is controlled by a controller 7 to create an image in accordance with image data. The image is created on a print medium 5. The print medium 5 may be transported past the array by a print medium transport mechanism 52. In the alternative, the array could be transported over the print medium by an array carriage. An array carriage could be used in conjunction with a print medium transport mechanism.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A printhead positioning mechanism comprising:

an arm mounted on a pivot member and having a first portion adapted to move along an arcuate path;

a printhead mounted on the first portion of the arm;

a voice coil motor for pivoting the arm about the pivot member to move said first portion through said arcuate path.

2. A printhead positioning mechanism according to claim 1, wherein the voice coil motor includes a voice coil mounted on the arm.

3. A printhead positioning mechanism according to claim 1, further comprising:

a position detection system coupled to the arm for generating position information.

4. A printhead positioning mechanism according to claim 3, wherein the position detection system includes a radial segment encoder.

5. A printhead positioning mechanism according to claim 4, wherein the radial segment encoder is mounted on the arm.

6. A printhead positioning mechanism according to claim 1, further comprising:

a controller capable of generating signals to control the printhead to eject ink.

7. A printhead positioning mechanism according to claim 6, wherein the controller generates the signals to control the printhead to eject ink in response to image data and in response to printhead position information.

8. A printhead positioning mechanism according to claim 7, wherein the printhead position information is provided by a printhead position detection system.

9. A printhead positioning mechanism according to claim 1, further comprising an ink feed element disposed on the arm.

10. A printhead positioning mechanism according to claim 1, wherein the printhead comprises an inkjet nozzle array.

11. A printhead positioning mechanism comprising:

an arm mounted on a pivot member and having a first portion adapted to move along an arcuate path;

a printhead mounted on the first portion of the arm a position detection system coupled to the arm for generating position information; and an end of travel detector.

12. A printhead positioning mechanism comprising:

an arm mounted on a pivot member and having a first portion adapted to move along an arcuate path;

a printhead mounted on the first portion of the arm; and a print medium edge detector.

13. A printhead positioning mechanism comprising:

an arm mounted on a pivot member and having a first portion adapted to move along an arcuate path;

a printhead mounted on the first portion of the arm;

a controller capable of generating signals to control the printhead to eject ink, wherein the controller generates the signals to control the printhead to eject ink in response to image data and in response to printhead position information, and wherein the signals to control the printhead are generated in further response to print medium edge position information generated by a print medium edge detector.

14. A printer comprising:

a frame;

an arm pivotally coupled to the frame and having a first portion adapted to move along an arcuate path;

a printhead mounted on the first portion of the arm;

a voice coil motor coupled to the arm for driving the arm along said arcuate path.

15. A printer according to claim 14, wherein the drive motor includes a voice coil mounted on the arm.

16. A printer according to claim 14, further comprising:

a position detection system coupled to the arm for generating position information.

17. A printer according to claim 16, wherein the position detection system comprises a radial segment encoder.

18. A printer according to claim 17, wherein the radial segment encoder is mounted on the arm.

19. A printer according to claim 14, further comprising:

a controller for generating signals to control the printhead to eject ink.

20. A printer according to claim 19, wherein the controller generates the signals to control the printhead to eject ink in response to image data and in response to printhead position information.

21. A printer according to claim 19, wherein the printhead position information is provided by a printhead position detection system.

22. A printer according to claim 14, further comprising:

a print medium transport mechanism.

23. A printer according to claim 14, further comprising a fluid delivery system.

24. A printer according to claim 23, wherein the fluid delivery system includes an ink delivery element disposed on the arm.

25. A printer according to claim 23, wherein the ink delivery system includes an ink reservoir.

26. A printer according to claim 23, further comprising an ink reservoir in fluid communication with an ink delivery element, the ink delivery element being disposed on the arm for providing ink to the printhead.

27. A printer according to claim 14, wherein the printhead comprises an inkjet nozzle array.

28. A printer comprising;

a frame;

an arm pivotally coupled to the frame and having a first portion adapted to move along an arcuate path;

a printhead mounted on the first portion of the arm;

a position detection system coupled to the arm for generating position information, wherein the position detection system includes an end of travel detector.

29. A printer comprising:

a first arm having a first printhead mounted thereon, the first arm being configured to rotate about a first axis;

a second arm having a second printhead mounted thereon, the second arm being configured to rotate about a second axis.

30. A printer according to claim 29, wherein the first printhead comprises an inkjet nozzle array.

31. A printer comprising:

an arm mounted on a pivot member;

a printhead mounted on the arm; and a carriage for linearly transporting the arm adjacent a print medium.

32. A printer according to claim 31, wherein the printhead comprises an inkjet nozzle array.

33. A computer comprising:

a hardware bay;

a printer integrated into the hardware bay, the printer including an arm mounted on a pivot member and adapted to move along an arcuate path, a printhead being mounted on the arm.

34. A computer according to claim 33, wherein the printhead comprises an inkjet nozzle array.

35. A printer comprising:

an array of printhead positioning units, the printhead positioning units each including an arm pivotably mounted on a pivot member and a printhead mounted on the arm for movement along an arcuate path.

36. A printer according to claim 35, wherein the printhead comprises an inkjet nozzle array.

37. A printer comprising:

means for moving a printhead in an arcuate path, said means comprising a voice coil motor; and means for delivering ink to the printhead.

38. A printer according to claim 37, wherein the printhead comprises an inkjet nozzle array.

39. A method of printing comprising:

actuating a voice coil motor to move a printhead in an arcuate path; and ejecting ink from the printhead.

40. The method of printing, in accordance with claim 39, further comprising:

generating signals to control the printhead to eject ink in response to image data.

41. The method of printing, in accordance to claim 39, further comprising:

detecting the position of the printhead.

42. The method of printing, in accordance with claim 41, further comprising:

generating signals to control the printhead to eject ink drops in response to image data and in response to the position of the printhead.

43. The method of printing, in accordance with claim 41, wherein the detecting the position of the printhead is performed with a radial segment encoder.

44. The method of printing, in accordance with claim 39, wherein said ejecting ink from the printhead comprises ejecting ink from an array of inkjet nozzles.

45. A method of printing comprising:

moving a printhead in an arcuate path;

ejecting ink from the printhead;

detecting the position of the printhead with an end of travel detector.

46. A method of printing comprising:

moving a printhead in an arcuate path;

ejecting ink from the printhead;

detecting the position of the printhead; and detecting the relative position of the printhead with respect to the edge of a print medium.

47. The method of printing, in accordance with claim 46, wherein the signals to control the printhead to eject ink are generated in further response to the relative position of the printhead with respect to the edge of the print medium.

* * * * *